US005456309A

United States Patent [19]

Vannucci, Jr.

[11] Patent Number: 5,456,309

[45] Date of Patent: Oct. 10, 1995

[54] METHOD OF TRANSFERRING HEAT BETWEEN A FEED MATERIAL AND HEAT EXCHANGE FLUID

[75] Inventor: Robin C. Vannucci, Jr., Taylor Lake Village, Tex.

[73] Assignee: Dixie Chemical Company, Pasadena, Tex.

[21] Appl. No.: 152,574

[22] Filed: Nov. 15, 1993

[51] Int. Cl.[6] ..... F28D 11/02

[52] U.S. Cl. ..... 165/1; 165/90; 165/91

[58] Field of Search ..... 165/1, 90, 91

[56] References Cited

U.S. PATENT DOCUMENTS

| | | | |
|---|---|---|---|
| 1,740,064 | 12/1929 | Boertlein | 165/91 |
| 2,068,779 | 1/1937 | Tunley et al. | 257/95 |
| 2,445,526 | 7/1948 | Heitz et al. | 202/51 |
| 2,603,457 | 7/1952 | Bishop | 257/95 |
| 2,650,034 | 8/1953 | Wiemer | 241/67 |
| 2,780,443 | 2/1957 | Holloway | 257/95 |
| 3,426,839 | 2/1969 | Overton | 165/89 |
| 3,633,663 | 1/1972 | Tafel | 165/89 |
| 3,771,591 | 11/1973 | no name . | |
| 4,627,176 | 12/1986 | Brieu | 165/90 |
| 4,805,554 | 2/1989 | McIntyre | 118/666 |

FOREIGN PATENT DOCUMENTS

| | | | |
|---|---|---|---|
| 483621 | 1/1916 | France | 165/91 |
| 251989 | 9/1948 | Switzerland | 165/91 |
| 2014487 | of 0000 | United Kingdom . | |

*Primary Examiner*—A. Michael Chambers

*Attorney, Agent, or Firm*—Pravel, Hewitt, Kimball & Krieger

[57] ABSTRACT

A method of transferring heat between a feed material and a heat exchange fluid employs a heat exchanger comprising (a) a hollow, cylindrical roller mounted on its longitudinal axis for rotation about said axis; (b) a manifold positioned in the hollow interior of said roller, said manifold comprising (b1) a central pipe which extends axially along the longitudinal axis of said roller, (b2) a plurality of spoke pipes, wherein said spoke pipes are in communication with said central pipe and with the hollow interior of said roller; (c) a supply means for introducing a heat exchange fluid into said central pipe; and (d) a discharge means for removing said heat exchange fluid from the hollow interior of said roller, so that said heat exchange fluid is sequentially introduced to said central pipe, transferred through said central pipe and then through said spoke pipes, so as to exit said spoke pipes and collide against the inside surface of said roller, thereafter turbulently mixing with the entire mass of said heat exchange fluid contained within the substantially full roller, and thereafter withdrawn from the hollow interior of said roller.

41 Claims, 3 Drawing Sheets

METHOD OF TRANSFERRING HEAT BETWEEN A FEED MATERIAL AND HEAT EXCHANGE FLUID

FIELD OF THE INVENTION

This invention relates to indirect heat transfer to and from the solid phase. Specifically, it relates to rotating-drum-type drying machines and flaking machines for use in the chemical processing industry.

Drying machines frequently generate their granular solid products by having a solution (or slurry) applied to a heated metal roller. The slurry features a volatile solvent which quickly evaporates, so that, in effect, the solute remaining is dried. These rotating-drum-type drying machines are commonly referred to as drum dryers. One common way of heating the drum dryer is to employ a hollow roller and to inject gaseous steam into the hollow interior of the roller, withdrawing the condensate with a siphon line.

Many flaking machines, or flakers, also operate by applying a feed material to a rotating drum. However, in the case of a flaker, the feed material is typically a relatively hot molten wax-like feed and the rotating drum is a cooled (rather than heated) metal roller. When this hot molten feed material is applied to the cooled metal roller, solidification occurs, and the product may then be collected.

These drum dryers and drum flakers represent two types of a general class of machines known as heat exchangers. In the case of the drum dryer, the transfer (or exchange) of heat occurs when heat passes from the outer surface of the heated rotating drum to the slurry, resulting in the drying of the solute. In the case of the drum flaker, the transfer of heat occurs when heat passes from the hot molten feed material to the outer surface of the cooled rotating drum.

Thus, this invention relates to an improved heat exchanger, which will prove itself to be particularly useful to those interested in performing flaking operations. However, the heat exchanger will doubtless also be useful in other applications in other industries. Rotating-drum designs are employed in grinding machines and printing machines as well, for example, and the advantages of the design of this invention may find excellent application in those technologies as well.

BACKGROUND OF THE INVENTION

Drum dryers and revolving-roller flakers have been employed in industry for many years. They have been applied to a wide range of chemical products (organic and inorganic), pharmaceutical compounds, waxes, soaps, and food products.

Key to the performance of these machines is the maintenance of a controlled temperature distribution across the outside surface of the roller. The outside surface of the roller is the surface upon which the feed material to be dried or flaked is deposited. A common design objective is for this temperature distribution to be substantially uniform, or constant, from one endwall of the cylindrical roller to the other. Another common objective is that, if the temperature on the outside surface of the roller is to vary, it do so in a gradual fashion and by a relatively small amount.

A common design for drum flakers involves the use of a hollow cylindrical roller. Within the interior of the roller, and along its longitudinal axis, is placed a central pipe. The pipe is perforated with holes. A heat exchange fluid, such as water, is pumped/transferred down the perforated central pipe. The fluid exits the central pipe through the numerous holes in a spray which strikes the inside surface of the roller. It is commonly observed that this cools the roller, which has been heated by the application of the heated molten feed material. A transfer of heat results (or the heat "flows") from the feed material to the roller wall (first to the outside surface then to the interior then to the inside surface) to the heat exchange fluid. The heat exchange fluid (now at an elevated temperature) then accumulates at the bottom of the substantially empty roller and is removed, commonly by means of a siphon line. See, e.g., U.S. Pat. No. 2,445,526; CHEMICAL ENGINEERS' HANDBOOK 11-40 to 11-41 (including FIGS. 11-26(*c*)–(*d*)) (Robert H. Perry & Cecil H. Chilton eds., 5th ed. 1973).

Another general approach has been to substantially fill the roller with heat exchange fluid, but to assure that good heat transfer and good subsequent mixing takes place by means of various baffling arrangements. See, e.g., U.S. Pat. No. 2,068,779; U.S. Pat. No. 3,633,663.

Only a few patents have employed a piping manifold to directly transfer a heat exchange medium directly to the inside surface of a heat exchange roller. U.S. Pat. No. 3,426,839 discloses a drum dryer design, which uses spoke pipes and longitudinal jet pipes to transfer gaseous steam from a central pipe to the roller wall. The longitudinal jet pipes are directly adjacent the inside surface of the roller, so that gaseous steam is distributed to the wall through tiny openings along the length of the jet pipe. The longitudinal jet pipes represented a good distribution mechanism for drum dryers employing gaseous steam.

U.S. Pat. No. 2,603,457 features the use of upwardly-directed jet injectors. This patent emphasizes quick withdrawal of the fluid, so that the hollow interior of the roller is never more than half full.

The present invention surpasses the prior art in that it provides an improved (and economic) temperature distribution across the outside surface of the heat exchange roller. In many cases, the desired temperature distribution is a uniform or only gradually varying one, and this invention is well adapted to generating these types of distributions.

It should be noted that the specification here provided simultaneously discloses both apparati and methods for exchanging heat. While it is anticipated that the present invention will primarily be used to effect flaking, as stated above, the apparati and methods here disclosed are well suited to other applications in other industries. Thus, for example, the invention is frequently referred to as either (a) a flaker or flaking machine, or (b) a heat exchanger. The latter designation is chosen to highlight that the instant invention includes non-flaking heat-exchange applications.

SUMMARY OF THE INVENTION

The heat exchanger of this invention comprises a hollow, cylindrical roller mounted for rotation on its longitudinal axis and a manifold positioned in the hollow interior of said roller. The manifold comprises a central pipe, extending axially along the longitudinal axis of said roller, and a plurality of spoke pipes. These spoke pipes are in communication with both the central pipe and the hollow interior of the roller. In one embodiment, the spoke pipes radiate from, and independently define a plurality of spoke pipe planes perpendicular to, the central pipe.

Heat exchange fluid is sequentially (a) introduced to the central pipe, (b) transferred through the central pipe and then through the spoke pipes, so as to exit the spoke pipes and collide against the inside surface of the roller, thereafter turbulently mixing with the entire mass of heat exchange fluid contained within the substantially full roller, and thereafter (c) withdrawn from the hollow interior of said roller.

DETAILED DESCRIPTION OF PREFERRED EMBODIMENT

Figure 1:
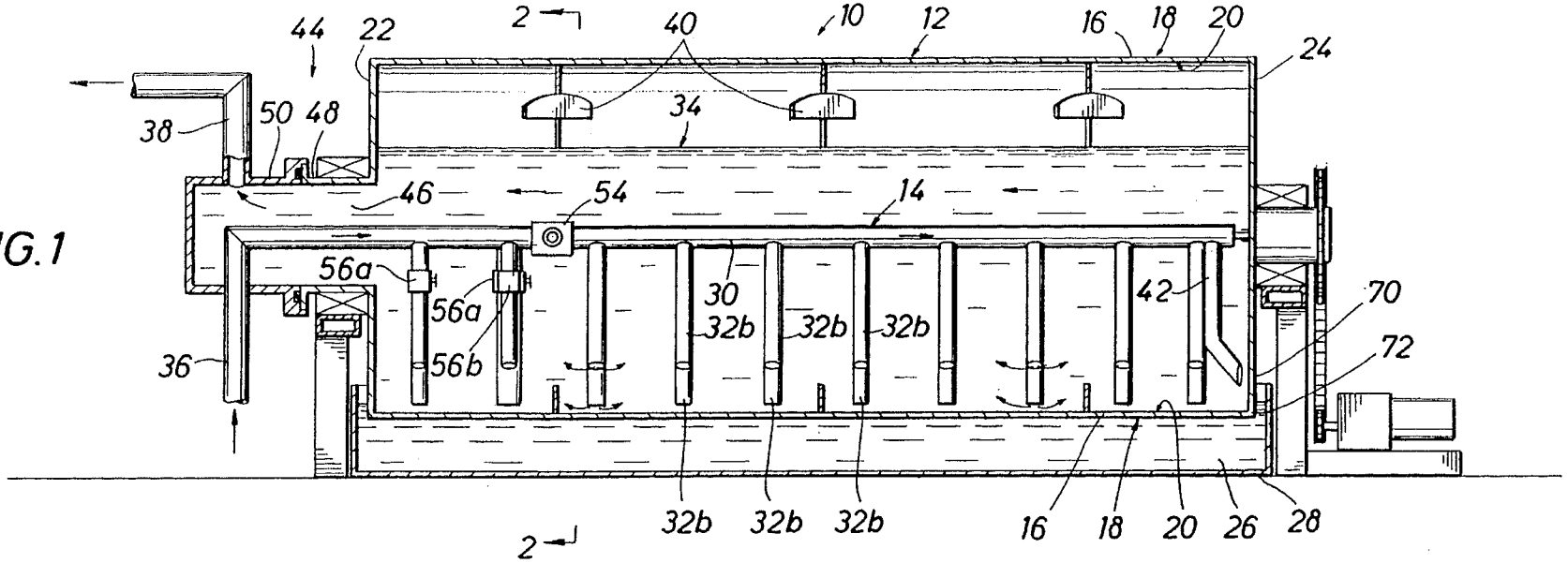
FIG. 1 is a front (longitudinal cross-sectional) view of the invention, operating as a flaking machine.

Referring to FIG. 1, the heat exchanger 10 of the present invention consists of a hollow cylindrical roller 12 and a manifold 14 positioned in the hollow interior of the roller. The roller 12 is mounted on its longitudinal axis for rotation about said axis. The two planar elements of the roller 12 (which its longitudinal axis intersects) are termed the endwalls 22 and 24 of the roller; the remaining element is the wall 16, the exterior surface of which is termed the outside surface of the roller 18, the interior surface of which is termed the inside surface of the roller 20. Thus, in a nutshell, the roller 12 comprises the wall 16 and two endwalls 22 and 24; the wall 16, in turn, features an outside surface 18 and an inside surface 20.

Figure 2:
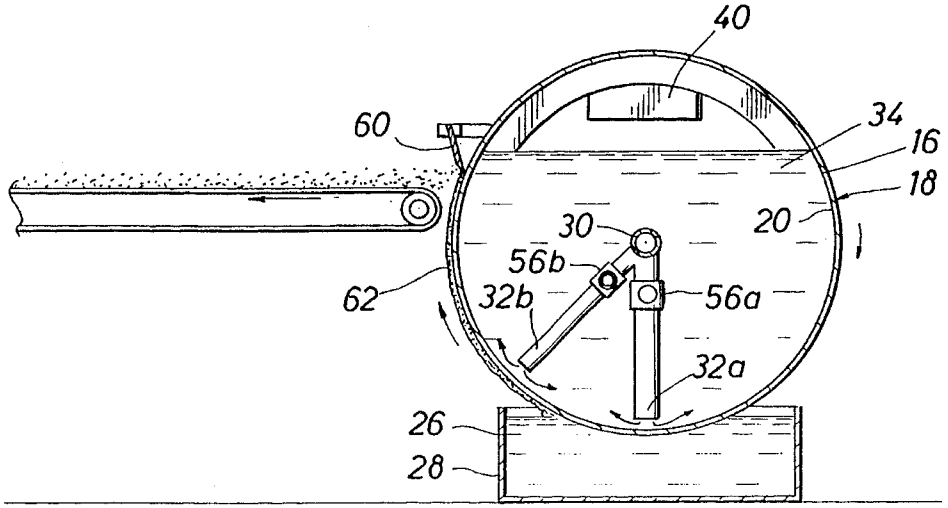
FIG. 2 is a side cross-sectional view of the invention, taken along the plane of line 2—2.

Referring to FIG. 2, the feed material 26 may be applied to and removed from the outside surface of the roller 18 in a variety of ways. For example, the feed material 26 may be applied by contacting the bottom of the outside surface of the constantly rotating roller 18 with a pool of feed material 26 confined in a feed pan 28. A layer 62 of the feed material 26 adheres to the rotating roller, and this layer is scraped off (for collection) by a metal blade 60 spanning the length of the roller. A clean outside surface of the roller 18 then contacts the remaining feed material 26 in the feed pan 28, repeating the process anew.

Referring again to FIG. 1, the improved heat exchanger 10 employs a manifold 14 comprising a central pipe 30, a plurality of spoke pipes 32*a* and 32*b*, a heat exchange fluid supply means 36, and a heat exchange fluid discharge means 38. When used, the heat exchanger contains a heat exchange fluid 34. The supply means 36 and the discharge means 38 are attached to an endwall of the roller, and they may be mounted on the same endwall (see endwall 22 in FIG. 1) or on opposite endwalls (see endwalls 22 and 24 in FIG. 4). Internally mounted baffles 40 to improve mixing may be employed (as disclosed in FIGS. 1–5 and as particularly disclosed in FIG. 3), as may feedback control of heat exchange fluid supply temperature and/or flow rate to minimize the effect of upsets to the steady-state operation of the system.

The manifold 14 consists of a central pipe 30 extending axially along the longitudinal axis of roller 12. Attached to this central pipe 30 are a plurality of perpendicularly mounted spoke pipes 32*a* and 32*b*, each of which is in communication with both the central pipe 30 and the interior of the hollow roller 12. Two spoke pipes 32*a* and 32*b* perpendicularly extending in different directions from the same longitudinal location on the central pipe 30 jointly and independently define a spoke pipe plane. A plurality of spoke pipe planes may thus be defined along the central pipe 30, transforming one large cylindrical volume into a number of smaller overlapping mixing zones. In FIG. 1, ten (10) pairs of spoke pipes and one endwall spoke pipe (at the extreme right-hand side of the roller interior in FIG. 1) appear. Thus, there are ten (10) spoke pipe planes defined by the spoke pipes in FIG. 1.

Figure 7:
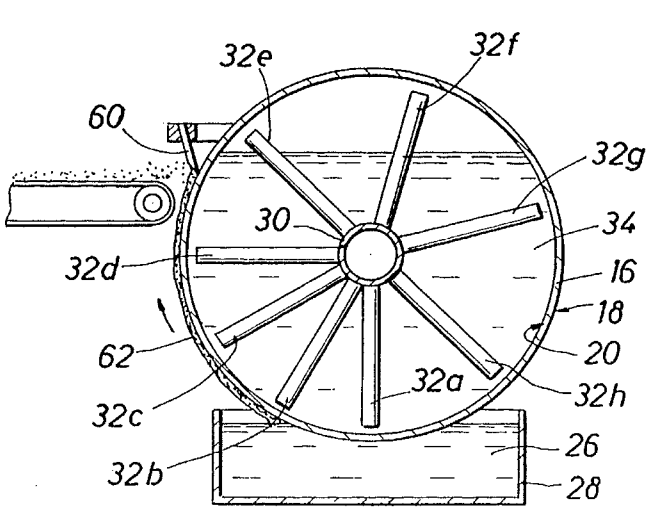
FIG. 7 is a side view of the invention, operating as a flaking machine, in which additional spoke pipes are provided at a lower portion of the roller.
Figure 6:
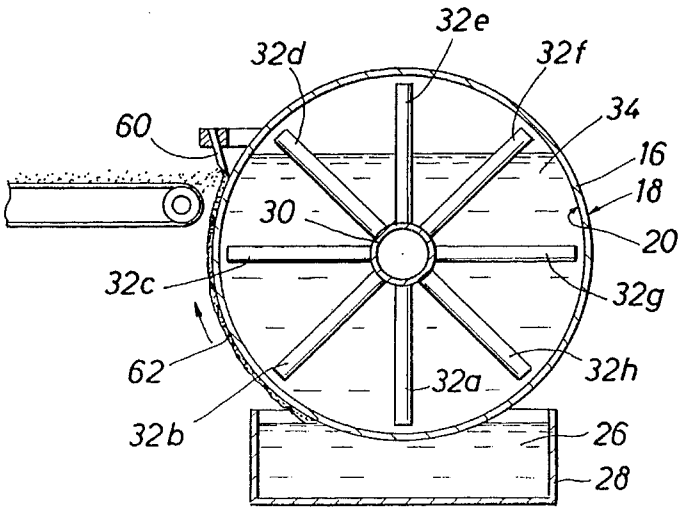
FIG. 6 is a side cross-sectional view of the invention, operating as a flaking machine, in which the spoke pipes are equally spaced within their respective spoke pipe planes.

FIGS. 6 and 7 reveal that the invention may encompass the use of numerous spoke pipes (denominated, for example, 32*a*, 32*b*, 32*c*, etc.) to maximize the rate of heat transfer and, hence, the production rate.

It will also be appreciated that the invention comprehends spoke pipe sets which do not exactly lie within a single spoke pipe plane. For example, spoke pipes 32*a*, 32*b*, etc. radiating from one longitudinal location on the central pipe 30 may be only approximately perpendicular. Similarly, the spoke pipes of a spoke pipe set may not radiate from exactly the same longitudinal location on the central pipe 30 (i.e., there may be some offset). In both cases, while these sets of spoke pipes may not mathematically define a spoke pipe plane (because the spoke pipes are not exactly perpendicular or because they do not originate from the exact same location on the central pipe), such a deviation will not adversely affect the operation of the invention.

Referring again to FIG. 1, a heat exchange fluid supply means 36 continuously introduces the heat exchange fluid 34 under pressure into the central pipe 30. The fluid 34 is then communicated to all of the spoke pipes 32*a* and 32*b* and thereafter to the hollow interior of the roller 12, substantially filling the roller. The substantially full state of the roller 12 is clearly disclosed in FIGS. 1–2 and 4–7. A discharge means 38 continuously removes the heat exchange fluid 34 from the interior of the roller 12.

The heat exchange fluid supply pressure must be sufficient to drive the fluid through the manifold 14, so that it exits the spoke pipes 32*a* and 32*b* with great velocity and momentum. The entire stream of fluid exiting a spoke pipe 32*a* and 32*b* should quickly collide against the inside surface of the rotating roller 20, only then to begin first substantially filling and later turbulently mixing the entire mass of said heat exchange fluid 34 contained within the substantially full roller 12. FIGS. 1–2 and 4–7 show the roller in its post-startup substantially full state of continuous operation.

At typical economical delivery pressures, the necessary turbulent mixing is best effected by ensuring that the spoke pipes 32*a* and 32*b* extend from the central pipe 30 to a point in close proximity with the inside surface of the roller 20. If higher pressures should be available, however, it is possible to shorten the spoke pipes 32*a* and 32*b* somewhat and still obtain satisfactory results. The key requirement is that the heat exchange fluid 34 exiting the spoke pipes 32*a* and 32*b* does so with sufficient momentum to collide with the inside surface of the roller 20, so as to exchange heat with the roller wall 16, before mixing and partially exchanging heat with the heat exchange fluid 34 in the hollow interior of the roller.

It should be noted that a nozzle 81 (see, e.g., FIG. 5) or nozzles may be attached to the end of one or more (or all of the) spoke pipes to increase the turbulence of the heat exchange fluid mixing which is occurring within the hollow interior of the roller. A nozzle 81 increases the turbulence by increasing the velocity with which the heat exchange fluid exits the spoke pipe. It increases this exit velocity by reducing the exit diameter of the spoke pipe.

If the heat exchange fluid temperature is lower than that of the feed material 26, heat will be transferred from the feed material 26 through the roller wall 16 to the heat exchange fluid 34, resulting in the cooling effect desired for flaking operations.

As an example of a flaking operation, and referring to FIGS. 1 and 2, a 5-foot diameter roller 12, twelve feet in length, has been operated effectively at a clockwise (viewed facing the fluid supply means as in FIG. 2) rotational speed of approximately 4 revolutions per minute. Within this roller 12, a 1.5-inch diameter central pipe 30 was fitted with 7 sets of pairs of 0.5-inch spoke pipes 32*a* and 32*b* (mounted at 6 o'clock and 8 o'clock, viewed facing the fluid supply means as in FIG. 2), each of which extended from the central pipe 30 to a point less than approximately 2 inches from the inside surface of the roller 20. The heat exchange fluid 34 used was water, and the roller was operated with the roller 12 approximately ⅔ full. At higher heat exchange fluid supply pressures, spoke pipe length might be reduced.

Substantially filling the roller with the heat exchange fluid 34 is important for a number of reasons. By substantially filling the roller, the time frame during which heat is transferred is extended. The material to be flaked spends a higher amount of time against the outside surface 18 of a roller wall 16 which is in direct contact (on its inside surface 20) with the heat exchange fluid 34, as compared to a flaker employing only a small amount of heat exchange fluid at the bottom of the roller. The feed material 26 thus spends a greater amount of time exchanging heat (i.e., it enjoys a longer residence time on a heat treated roller surface 18), inviting operators to gradually increase the rotational speed of the roller, increasing the rate of production of heat-exchanged material.

The mixing regime which occurs within the roller 12 is important in that thorough turbulent mixing contributes to a uniform (or, at least no more than a very gradually varying) temperature distribution across the outside surface of the roller 18. The design of this invention ensures that this turbulent mixing will occur.

Figure 4:
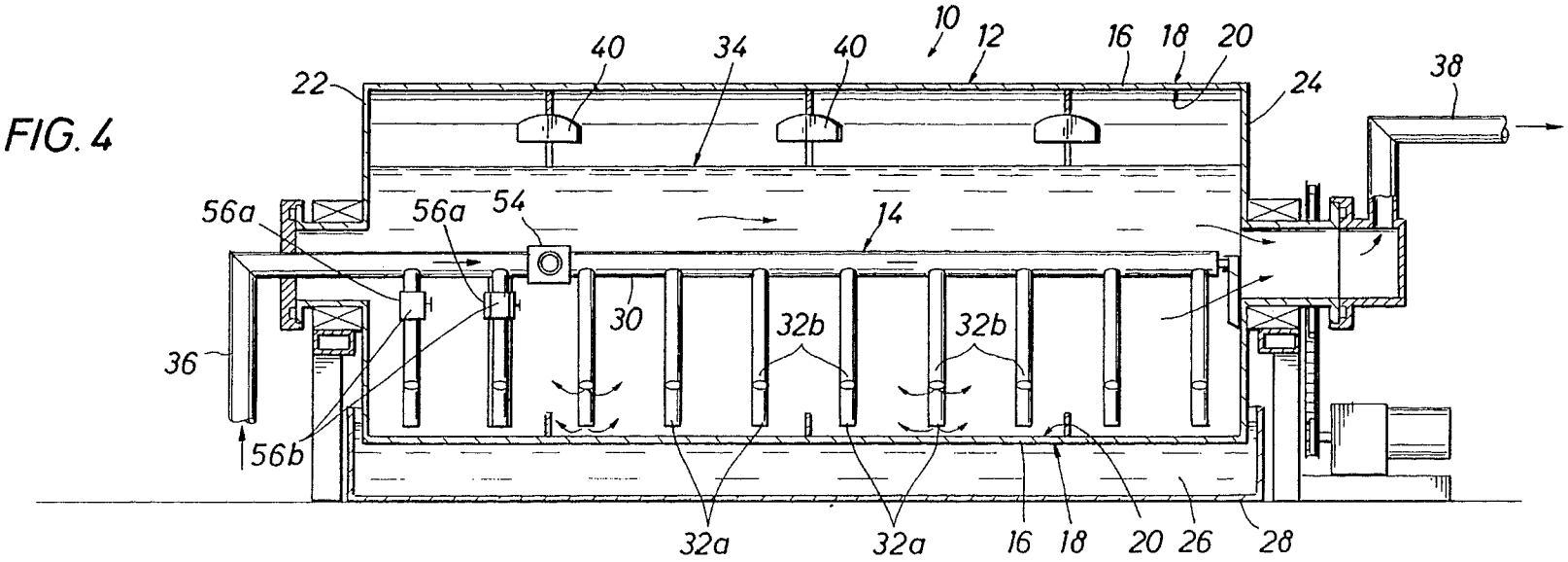
FIG. 4 is a front (longitudinal cross-sectional) view of the invention, operating as a flaking machine, wherein the heat exchange fluid enters the roller through one endwall and exits the roller through the opposite endwall.

Referring to FIG. 4, it will be understood that, as a result of this turbulence, the roller can be expected to operate successfully regardless of whether the heat exchange fluid is withdrawn from the same side (see FIG. 1) or from the side opposite (see FIG. 4) that at which the fluid is introduced into the system.

Referring again to FIG. 1, regardless of whether fluid is withdrawn from the same side or from the opposite side of the point at which it is introduced, internal mixing baffles 40 can be employed to good effect to further ensure temperature uniformity. One arrangement, disclosed in FIGS. 1–5, comprises a plurality of baffles 40, said baffles 40 individually comprising a substantially rectangular plate mounted on one longitudinal edge to the inside surface of the roller 20. The mounted edge forms an approximate 45 degree angle (see particularly the lower set of baffles in FIG. 3) with the longitudinal axis of said roller 12 so that, upon rotation of said roller 12, the heat exchange fluid 34 in local/substantial contact with the baffle 40 will be directed away from said baffle. In this particular example, the heat exchange fluid 34 will be directed away from said discharge means 38. This would ensure that, while the mass average flow vector of the heat exchange fluid 34 may well be in the direction of the fluid discharge means 38, numerous contra-directed currents and eddies are created which enhance mixing and temperature uniformity.

Figure 5:
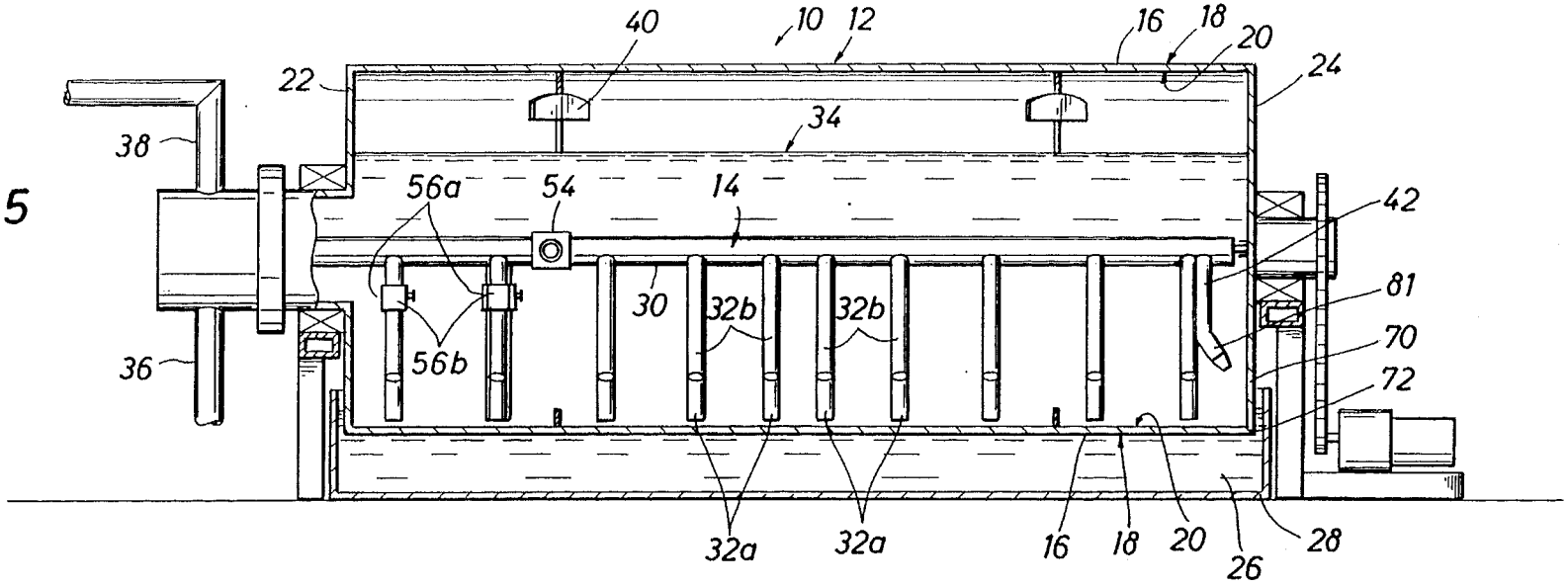
FIG. 5 is a front (longitudinal cross-sectional) view of the invention, operating as a flaking machine, wherein additional spoke pipes are provided at the central portion of the roller.

In some applications, heat transfer losses are greater at the endwalls 22 and 24; in others, the heat transfer rate is altered because the mounting of the endwalls 22 and 24 on the roller wall 16 introduces an additional layer of metal through which heat must be transferred. In both cases, one or more endwall spoke pipes 42 can be profitably employed to ensure a uniform temperature distribution on the outside surface of the roller 18 which extends from one endwall 22 of the roller to the other endwall 24. FIGS. 1 and 5 disclose a heat exchanger which features heat losses at endwall 24, so an endwall spoke pipe 42 has been employed.

As in the case of the conventional spoke pipes, the endwall spoke pipe 42 radiates from and communicates with both the central pipe 30 and the hollow interior of the roller 12. However, the endwall spoke pipe 42 aims the heat exchange fluid not directly to the inside surface of the roller 20, but, rather, to a point 70 on the endwall of the roller in close proximity with the point 72 where the endwall (in FIG. 1, endwall 24) meets the inside surface of the roller 20. In the example described above, the endwall spoke pipe directed water to a point on the endwall approximately 2 to 6 inches from the point where the endwall met the inside surface of the roller.

Referring to FIGS. 1, 5, 6, and 7, and comparing these figures, it will be appreciated that a variety of temperature distributions may be maintained through careful placement of the spoke pipes.

Referring to FIGS. 1 and 6, it will be appreciated that, if a uniform temperature distribution along the entire outside surface of the roller 18 is desired, this temperature distribution may usually be maintained by (a) equally spacing the spoke pipe planes along the longitudinal axis of the roller 12 (see FIG. 1), and (b) equally spacing the spoke pipes 32*a*, 32*b*, 32*c*, etc. lying in a spoke pipe plane as well (see FIG. 6). These spoke pipes may be supplemented with endwall spoke pipes 42 (see FIG. 1) if it should be believed that additional heat losses are occurring there.

Referring to FIGS. 1 and 5, and comparing these figures, one recognizes that, if it should be believed that a heat loss is occurring at a specific longitudinal location, additional spoke pipe planes directed to that location may be employed to offset that heat loss. For example, in FIG. 1, because heat losses are uniform along the length of the roller, the spoke pipe planes are uniformly distributed along the roller. Endwall heat losses are met by the endwall spoke pipe 42. By contrast, in FIG. 5, additional heat losses at the central portion of the roller are met by additional spoke pipe planes placed at that location.

Referring to FIGS. 6 and 7, and comparing these figures, if it should be believed that a heat loss is occurring at a specific radial location, additional spoke pipes directed to that location may be employed to offset that heat loss as well. For example, in FIG. 6, the spoke pipes 32*a*, 32*b*, 32*c*, etc. are evenly distributed about the central pipe. By contrast, in FIG. 7, some of these spoke pipes have been redirected to a particular radial location to offset a heat loss occurring there.

It will be readily appreciated that, at a constant rate of rotation, feed material thickness, and feed material temperature, one can increase the amount of heat transferred to or withdrawn from the feed material 26 by increasing (a) the difference between the temperature of the heat exchange fluid entering the roller and the temperature of the feed material 26 applied to the outside surface of the roller, (b) the rate at which the heat exchange fluid is introduced and withdrawn from the roller, or (c) both of these parameters. Feedback control of heat exchange fluid supply temperature and/or the heat exchange fluid supply flow rate minimizes the effect of upsets to the steady-state operation of the system. One useful control regime consists of adjusting the flow rate of the heat exchange fluid entering the roller in response to changes in the temperature of (a) the feed material 26 removed from the outside surface of the roller, (b) the heat exchange fluid exiting the roller, or (c) the roller surface itself, so as to maintain control over these latter parameters.

It should be noted that a separately manufactured stationary heat exchange manifold 14 makes possible the addition of practical flaking capability to some drum dryers. These drum dryers have commonly utilized gaseous steam, as opposed to a heat exchange fluid, to heat the roller wall. Furthermore, these drum dryers commonly operate with no internal manifold.

Figure 3:
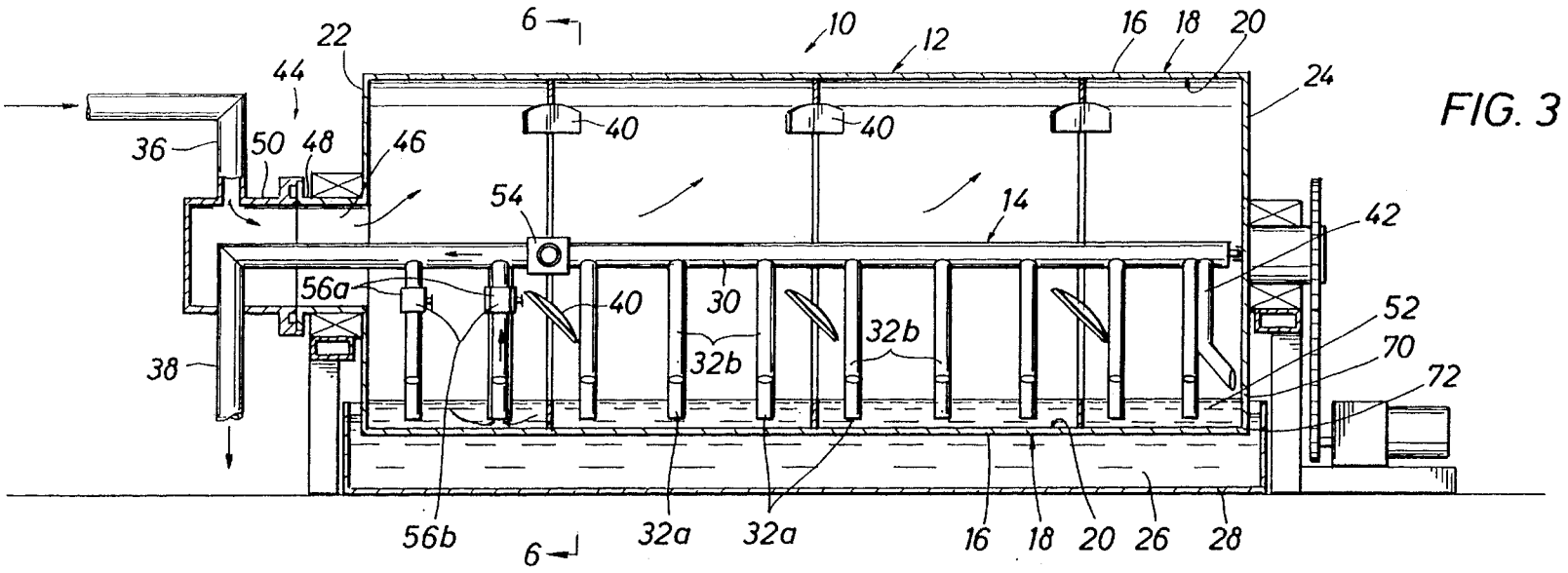
FIG. 3 is a front (longitudinal cross-sectional) view of the invention, operating as a steam-heated drum dryer.

Referring to FIGS. 1 and 3, a separately manufactured heat exchange manifold 14 may easily be inserted into a drum dryer with no adverse effects on the dryer's mode or efficiency of operation. Furthermore, once installed, the separately manufactured manifold allows the same rotating drum to now serve as both a drum dryer (see FIG. 3) or as a drum flaker (see FIG. 1).

Referring to FIG. 3, the heat exchange manifold 14 comprises the central pipe 30 and the spoke pipes 32*a* and 32*b* as described above. If necessary, the heat exchange manifold 14 may further comprise an outer concentric pipe section 44, wherein said outer concentric pipe section 44 has an inside diameter greater than the outside diameter of said central pipe 30, thus defining an annular passageway 46. This outer concentric pipe section 44 comprises two fittings. The first fitting 48 secures said outer concentric pipe section to the endwall 22 of a hollow, cylindrical roller 12, so that said annular passageway 46 is in communication with the interior of said roller 12. The second fitting 50 allows for introducing or withdrawing gaseous or fluidic heat exchange media to or from said annular passageway 46. Alternatively, the outer concentric pipe section 44 may constitute a part of the drum dryer to which the manifold 14 is to be attached.

By way of overview, and again referring to FIG. 3, when the heat exchanger 10 is to be operated as a steam-based drum dryer, steam will be introduced into the outer concentric pipe section 44, said steam traveling through the annular passageway 46 into the hollow interior of the roller 12. There, within the hollow interior, the steam free mixes, collides and heat exchanges with the inside surface of the roller 20, and condenses, forming a pool of condensate 52. The steam pressure will force accumulated condensate 52 to exit the system through one or more spoke pipes 32*a* (discussed in detail below) and the central pipe section with which they are in communication.

When the heat exchanger 10 is to be operated as a flaker, as disclosed in FIG. 1, the heat exchange fluid 34 will be introduced into the central pipe 30, said heat exchange fluid 34 traveling through the spoke pipes 32*a* and 32*b* into the hollow interior of the roller 12 as discussed extensively above. The heat exchange fluid 34 exits through the annular passageway 46 defined by the outer concentric pipe section 44.

When the heat exchanger 10 is to be operated as a steam-based drum dryer, as disclosed in FIG. 3, steam/condensate passage through the spoke pipes 32*a* and 32*b* is controlled as follows. A single central pipe valve 54 is installed between, for example, the second and third spoke pipe planes, viewed from the endwall to which the heat exchange manifold 14 is to be attached. The spoke pipes of the first and second spoke pipe planes would be fitted with spoke pipe valves 56*a* and 56*b*. In this example, during downtime, operators could easily reach the central pipe valve 54 and the spoke pipe valves 56*a* and 56*b* from the roller endwall 22 by hand.

When the heat exchanger 10, fitted with the heat exchange manifold 14, is to be operated as a drum dryer, using gaseous steam as the heat exchange media, as disclosed in FIG. 3, only one spoke pipe 32*a* will likely be needed to discharge accumulated condensate 52. Thus, the central pipe valve 54 is closed, effectively isolating the majority of the spoke pipes 32*a* and 32*b*, so that condensate 52 is discharged (in an upward direction) through the downwardly directed spoke pipes 32*a* of the first or second spoke pipe planes. Again, because only one spoke pipe 32*a* may be needed to discharge the condensate 52, one spoke pipe valve 56*a* may be opened and the other spoke pipe valve 56*a* closed.

When the heat exchanger 10, fitted with the heat exchange manifold 14, is to be operated as a flaker, as disclosed in FIG. 1, using a heat exchange fluid 34 as the heat exchange media, the system operates as described fully above. The central pipe valve 54 is opened. The heat exchange fluid 34 is introduced to the central pipe 30 for communication through the spoke pipes 32*a* and 32*b*, so as to substantially fill the roller 12 (note that the central pipe valve 54 and all of the spoke pipe valves 56*a* and 56*b* are now open). The heat exchange fluid 34 then exits the system through the outer concentric pipe section 44. Once again, the spoke pipes of the manifold may be specifically configured to address heat losses occurring at specific locations.

Finally, it should be noted that, in other industries, it is conceivable that it may be desired to employ the heat exchanger design disclosed in FIG. 1 to effect drying, even though this specification anticipates that said design will most frequently be employed to effect flaking. If the heat exchange fluid temperature is higher than that of the feed material 26, heat will be transferred from the heat exchange fluid 34 through the roller wall 16 to the feed material 26, resulting in the heating effect desired for drying operations.

What is claimed is:

1. A method of transferring heat between a feed material and a heat exchange fluid comprising:

(a) applying the feed material to the outside surface of a rotating heat exchanger, wherein said heat exchanger comprises (1) a hollow, cylindrical roller substantially filled with a heat exchange fluid, wherein said cylindrical roller has a cylindrical wall and two endwalls and is mounted on its longitudinal axis for rotation about said axis; and (2) a manifold positioned in the hollow interior of said roller, said manifold comprising (a) a central pipe which extends axially along the longitudinal axis of the roller, (b) a plurality of spoke pipes, wherein the spoke pipes are in communication with the central pipe and the hollow interior of the roller (b) introducing a heat exchange fluid stream under pressure into the central pipe of said manifold for communication to said spoke pipes; and (c) ejecting the heat exchange fluid stream from said spoke pipes at a sufficient velocity such that the ejected stream impinges upon the wall of said roller wherein the ejected heat exchange fluid stream is mixed with the entire mass of the heat exchange fluid within the cylindrical roller; the stream of admixed heat exchange fluid being subsequently removed from the hollow interior of said roller.

2. The method of claim 1 wherein said spoke pipes extend from said central pipe to a point in close proximity with the inside surface of said roller.

3. The method of claim 1 wherein said heat exchange fluid stream is introduced into said central pipe under pressure sufficient to ensure that substantially all of the heat exchange fluid stream exiting said spoke pipes is directed to and impinges upon the inside surface of said roller before mixing with the heat exchange fluid contained within the cylindrical roller.

4. The method of claim 1 wherein the heat exchange fluid stream is introduced into and the admixed heat exchange fluid is removed from the same side of the cylindrical roller.

5. The method of claim 1 wherein the admixed heat exchange fluid is removed from the opposite side of the roller to which the heat exchange fluid stream is introduced.

6. The method of claim 1 wherein said spoke pipes radiate approximately perpendicularly from said central pipe and independently define a plurality of spoke pipe sets.

7. The method of claim 1 wherein said heat exchanger further comprises a plurality of baffles, said baffles individually comprising a plate mounted at an angle to the longitudinal axis of said roller, so that, upon rotation of said roller, said heat exchange fluid in substantial contact with said baffle will be directed away from said baffle.

8. The method of claim 1 wherein said heat exchanger further comprises at least one endwall spoke pipe, wherein said endwall spoke pipe radiates from and communicates with said central pipe and is within the hollow interior of the roller, and wherein said endwall spoke pipe directs said heat exchange fluid stream to a point on an endwall of said roller in close proximity with the point where said endwall meets the inside surface of said roller.

9. The method of claim 1 wherein the heat exchanger further comprises at least one nozzle mounted to the end of at least one spoke pipe.

10. The method of claim 1 wherein the feed material is applied to the outside surface of the rotating heat exchanger by contacting the bottom of the cylindrical roller with a pool of feed material confined in a feed pan.

11. The method of claim 1 wherein the heat exchange fluid is continuously introduced under pressure into the central pipe.

12. The method of claim 1 wherein the stream of fluid exiting the spoke pipe impinges against the inside surface of the rotating roller and is subsequently admixed with the entire mass of the heat exchange fluid within the substantially full roller.

13. The method of claim 1 wherein the heat exchanger further comprises a means mounted to the end of at least one of the spoke pipes for increasing the turbulence of the heat exchange fluid mixing within the hollow interior of the roller.

14. The method of claim 1 wherein the heat exchange fluid is maintained at a lower temperature than that of the feed material.

15. The method of claim 1 wherein a uniform temperature distribution is maintained along the outside surface of the roller.

16. The method of claim 1 wherein the roller is rotated at a substantially constant speed.

17. The method of claim 1 wherein step (a) through step (c) are continuously repeated.

18. The method of claim 1 wherein the heat exchange fluid stream is steam and further wherein the heat exchange fluid within the cylindrical roller is condensed steam.

19. The method of claim 1 wherein the roller is rotated at a substantially constant speed.

20. The method of claim 17 wherein a uniform temperature distribution is maintained along the outside surface of the roller.

21. The method of claim 17 wherein the heat exchange fluid is maintained at a lower temperature than that of the feed material.

22. The method of claim 17 wherein the feed material is applied to the outside surface of the rotating heat exchanger by contacting the bottom of the cylindrical roller with a pool of feed material confined in a feed pan.

23. The method of claim 17 wherein the heat exchange fluid stream is steam and further wherein the heat exchange fluid within the cylindrical roller is condensed steam.

24. A method of transferring heat between a feed material and a heat exchange fluid comprising:

(a) applying said feed material to the outside surface of a heat exchanger, said heat exchanger comprising:

(1) a hollow, cylindrical roller, said roller comprising a cylindrical wall and two endwalls, said roller mounted on its longitudinal axis for rotation about said axis, (2) a manifold positioned in the hollow interior of said roller, said manifold comprising (a) a central pipe which extends axially along the longitudinal axis of said roller, (b) a plurality of spoke pipes, wherein said spoke pipes are in communication with said central pipe and with the hollow interior of said roller, (3) a supply means for introducing under pressure said heat exchange fluid into said central pipe for communication to said spoke pipes and thereafter to the hollow interior of said roller substantially filling said roller, and (4) a discharge means for removing said heat exchange fluid from the hollow interior of said roller, so that said heat exchange fluid is sequentially introduced to said central pipe, transferred through said central pipe and then through said spoke pipes, so as to exit said spoke pipes and collide against the inside surface of said roller, thereafter turbulently mixing with the entire mass of said heat exchange fluid contained within the substantially full roller, and thereafter withdrawn from the hollow interior of said roller; and (b) rotating said roller at a substantially constant speed.

25. The heat exchange method of claim 24 wherein said spoke pipes extend from said central pipe to a point in close proximity with the inside surface of said roller.

26. The heat exchange method of claim 24 wherein said heat exchange fluid is introduced into said central pipe under pressure sufficient to ensure that substantially all of the heat exchange fluid exiting said spoke pipes is directed to and collides with the inside surface of said roller before mixing with the heat exchange fluid contained within the substantially full roller.

27. The heat exchange method of claim 24 wherein said supply means and said discharge means are mounted on the same endwall of said roller.

28. The heat exchange method of claim 24 wherein said supply means and said discharge means are mounted on opposite endwalls of said roller.

29. The heat exchange method of claim 24 wherein said spoke pipes radiate approximately perpendicularly from said central pipe and independently define a plurality of spoke pipe sets.

30. The heat exchange method of claim 29 wherein (a) said spoke pipe sets are equally spaced along the longitudinal axis of said roller, and (b) said spoke pipes lying in a spoke pipe set are equally spaced about said central pipe.

31. The heat exchange method of claim 29 wherein said spoke pipe sets are unequally spaced along the longitudinal axis of said roller.

32. The heat exchange method of claim 29 wherein the spoke pipes lying in a spoke pipe set are unequally spaced about said central pipe.

33. The heat exchange method of claim 24 further comprising a plurality of baffles, said baffles individually comprising a plate mounted at an angle to the longitudinal axis of said roller, so that, upon rotation of said roller, said heat exchange fluid in substantial contact with said baffle will be directed away from said baffle.

34. The heat exchange method of claim 24 further comprising at least one endwall spoke pipe, wherein said endwall spoke pipe radiates from and communicates with said central pipe and with the hollow interior of the roller, and wherein said endwall spoke pipe directs said heat exchange fluid to a point on an endwall of said roller in close proximity with the point where said endwall meets the inside surface of said roller.

35. The heat exchange method of claim 24 further comprising at least one nozzle mounted to the end of at least one spoke pipe.

36. The method of claim 24 wherein the feed material is applied to the outside surface of the rotating heat exchanger by contacting the bottom of the cylindrical roller with a pool of feed material confined in a feed pan.

37. The method of claim 24 wherein the heat exchange fluid is maintained at a lower temperature than that of the feed material.

38. The method of claim 24 wherein a uniform temperature distribution is maintained along the outside surface of the roller.

39. The method of claim 38 wherein (a) said spoke pipes sets are equally spaced along the longitudinal axis of said roller, and (b) said spoke pipes lying in a spoke pipe set are equally spaced about said central pipe.

40. The method of claim 38 wherein said spoke pipe sets are unequally spaced along the longitudinal axis of said roller.

41. The heat exchange method of claim 38 wherein the spoke pipes lying in a spoke pipe set are unequally spaced about said central pipe.

* * * * *